US006109040A

United States Patent [19]

Ellison, Jr. et al.

[11] Patent Number: 6,109,040

[45] Date of Patent: Aug. 29, 2000

[54] STIRLING CYCLE REFRIGERATOR OR ENGINE EMPLOYING THE ROTARY WANKEL MECHANISM

[75] Inventors: Woodrow R. Ellison, Jr., Glendale; Kerry R. Kohuth, Waddell; Michael E. Craghead, Tempe, all of Ariz.

[73] Assignee: General Pneumatics Corporation, Orange, N.J.

[21] Appl. No.: 09/289,918

[22] Filed: Apr. 12, 1999

[51] Int. Cl.[7] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 2,988,065 | 6/1961 | Wankel et al. | 123/8 |
| 3,426,525 | 2/1969 | Rubin | 60/24 |
| 3,483,694 | 12/1969 | Huber et al. | 62/6 |
| 3,537,256 | 11/1970 | Kelly | 62/6 |
| 3,762,167 | 10/1973 | Wahnschaffe et al. | 60/24 |
| 3,763,649 | 10/1973 | Wahnschaffe et al. | 60/24 |
| 3,853,437 | 12/1974 | Horn et al. | 418/61 |
| 5,442,923 | 8/1995 | Bareiss | 62/6 |

*Primary Examiner*—Ronald Capossela
*Attorney, Agent, or Firm*—Warren F. B. Lindsley; Frank J. McGue

[57] ABSTRACT

A non-reciprocating Stirling-cycle machine which overcomes problems associated with high drive mechanism forces and vibration that seriously hamper reciprocating Stirling-cycle machines. The design employs Wankel rotors instead of the reciprocating pistons used in prior Stirling machines for effecting the compression and expansion cycles. Key innovations are the use of thermodynamic symmetry to allow coupling of the rotating compression and expansion spaces through simple stationary regenerators, and the coordination of thermodynamic and inertial phasing to allow complete balancing with one simple passive counterweight, which is not possible in reciprocating machines. The design can be scaled over a wide range of temperatures and capacities for use as a cryogenic or utilitarian refrigerator or to function as an external heat powered engine.

4 Claims, 3 Drawing Sheets

STIRLING MACHINE

WANKEL MECHANISM

Ø = 0°

Ø = 90°

Ø = 180°

Ø = 270°

FIG. 4.
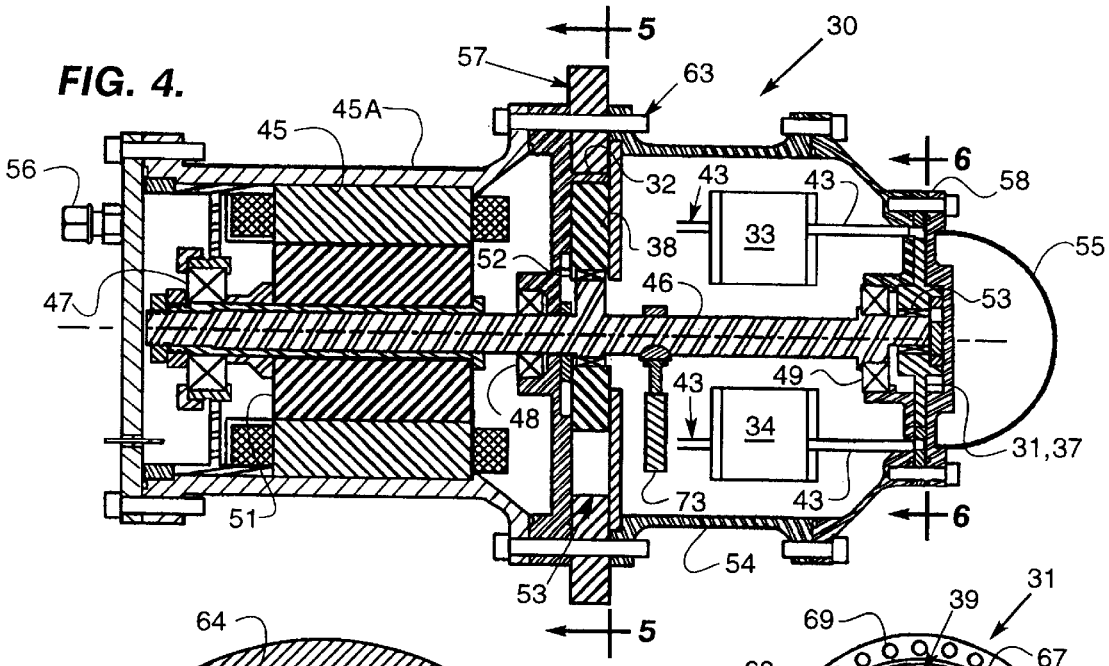
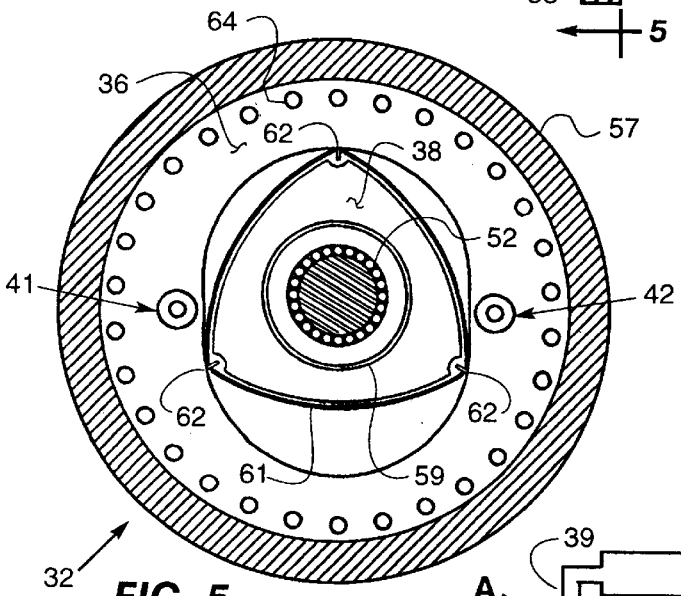
FIG. 5.
COMPRESSION MECHANISM
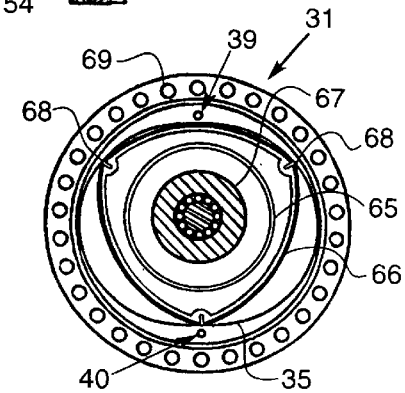
FIG. 6.
EXPANSION MECHANISM
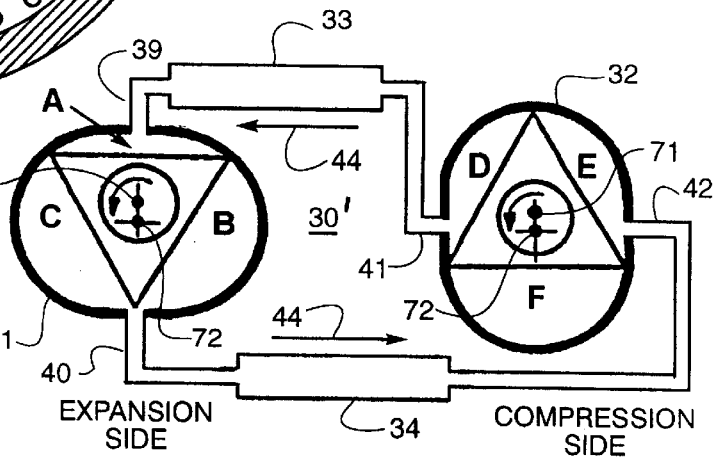
FIG. 7.

STIRLING CYCLE REFRIGERATOR OR ENGINE EMPLOYING THE ROTARY WANKEL MECHANISM

BACKGROUND OF THE INVENTION

There is a growing need for efficient self-contained closed-cycle cryocoolers. Refrigeration to 80K or below is required for many emerging low temperature electronic systems such as for super computers, communications equipment, space craft, military electronic countermeasure systems, magnetometers, and nuclear monitoring and counter-proliferation detectors. This need will rapidly increase as devices employing higher temperature (above 80K) superconductors are developed.

The Stirling cycle cryocooler offers considerable promise for these applications. It has proven to be the most suitable type of small closed-cycle cryocooler for cooling to temperatures in the range of 80K. In addition, Stirling machines may be used over a wide range of refrigeration temperatures, and, with suitable modification, may function as engines converting heat input to shaft power output. Stirling engines offer the advantages of quiet operation and the capability to utilize a wide variety of external heat sources, such as low grade fuels, waste heat, geothermal and solar energy. However, currently available Stirling machines employ reciprocating pistons and are consequently very difficult to balance, generate excessive vibration, and are subject to high drive mechanism forces due to the reversing accelerations.

The present invention defines an improved Stirling cycle machine which employs the Wankel rotary mechanism instead of the reciprocating pistons used in prior art Stirling machines for effecting the compression and expansion cycle. The advantages of this new form of Stirling machine include improved efficiency, reduced drive forces and vibration, extended operating life, the use of simple stationary regenerators, and the capability of being completely balanced with a single passive counterweight.

DESCRIPTION OF THE PRIOR ART

A novelty search turned up the following patents covering Stirling machines incorporating the Wankel rotary mechanism.

Rubin (U.S. Pat. No. 3,426,525) describes an external combustion engine which employs two trochoidal chambers, each with a Wankel rotor connected to drive an output shaft. The chambers each have two sets of inlet and outlet ports and are interconnected through two closed-circuit regenerative loops which carry unidirectional gas flow.

Fezer (U.S. Pat. No. 3,509,718) describes a hot gas machine for converting heat energy to mechanical energy. The machine employs two epitrochoidal chambers which each contain a hollow, triangular rotary piston. The chambers communicate via passage means in the pistons which are interconnected by a rotating double wall pipe having an annular intermediate section with regenerative means.

Wahnschaffe (U.S. Pat. Nos. 3,762,167 and 3,763,649) describes a hot gas rotary piston engine comprising two epitrochoidal housings, each containing a triangular rotary piston and each having two inlet ports and two outlet ports which are interconnected via heaters, regenerators and coolers much the same as described in Rubin U.S. Pat. No. 3,426,525. The engine described in U.S. Pat. No. 3,763,649 also incorporates control valves which direct the flow between inlet and outlet ports as appropriate.

Another prior art machine described by Horn (U.S. Pat. No. 3,853,437) employs a single Wankel mechanism as a compressor to drive a remotely located reciprocating displacer. Two of the Wankel compressor chambers are shorted to the crankcase and the third chamber supplies pressure pulses to the remote displacer to function as a cryogenic cooler.

The present invention is intended to operate as a cryocooler, although it may also operate as a heat driven engine. Like the prior art machines cited above, it incorporates two epitrochoidal housings with two Wankel rotary pistons but the two housings each have only two ports and are interconnected by only two separate oscillating-flow, closed-cycle regenerative passages rather than by two loops (which require four ports and interconnecting passages). In addition, the present invention discloses a novel balancing means comprising a single passive counterweight which simultaneously cancels the unbalance forces and moments of both of the Wankel rotors.

SUMMARY OF THE INVENTION

In accordance with the present invention, an improved refrigerator is disclosed for cooling various devices to very low temperatures, such as 80K or below, with a nominal 300K ambient heat sink.

It is, therefore, one object of the present invention to provide an improved self-contained refrigerator for cooling emerging electronic devices.

Another object of this invention is to provide an improved refrigerator based on the Stirling cycle which has proven to be the most efficient cycle for small closed-cycle cryocoolers.

A further object of this invention is to provide such an improved cryocooler which will refrigerate to very low temperatures such as 80 degrees K or below.

A still further object of this invention is to provide such an improved refrigerator that is readily controllable and/or scalable for cooling to different temperatures and capacities for specific cryogenic or utilitarian freon-free refrigeration applications.

A still further object of this invention is to provide an improved Stirling refrigerator or engine in a form which is effectively balanced mechanically by means of a single passive counterweight to minimize vibration.

A still further object of this invention is to provide such an improved Stirling refrigerator or engine which employs simple stationary regenerators.

A still further object of this invention is to provide such an improved Stirling refrigerator or engine in a form which effectively resolves fundamental problems associated with limited operating speed, high drive forces and vibration which seriously hamper reciprocating Stirling machines.

A still further object of this invention is to provide such an improved Stirling refrigerator or engine which operates in continuous unidirectional rotation rather than in a reciprocating mode.

Yet another object of this invention is to provide the above described features in such an improved Stirling refrigerator or engine through the incorporation of the proven Wankel rotary mechanism in place of the reciprocating pistons of prior art Stirling machines.

Other objects and advantages of this invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described with reference to the accompanying drawings, in which:

FIG. 4 is a cross-section drawing illustrating the structure of first embodiment of the cryocooler form of the invention;

FIG. 5 is a cross-sectional view of FIG. 4 taken along line 5—5 showing the configuration of the compression mechanism of the cryocooler of the invention;

FIG. 6 is a cross-sectional view of FIG. 4 taken along line 6—6, showing the configuration of the expansion mechanism of the cryocooler of the invention; and FIG. 7 illustrates a modification of the cryocooler of the invention which enables balancing of the cryocooler with a single counterweight.

DESCRIPTION OF THE PREFERRED EMBODIMENT

Prior to entering into a detailed description of the improved cryocooler form of the invention, a brief description of prior art reciprocating Stirling machines is in order as well as a brief description of the prior art Wankel rotary mechanism which is incorporated in the cryocooler of the invention in place of the reciprocating pistons of the prior art Stirling machine.

Figure 1:
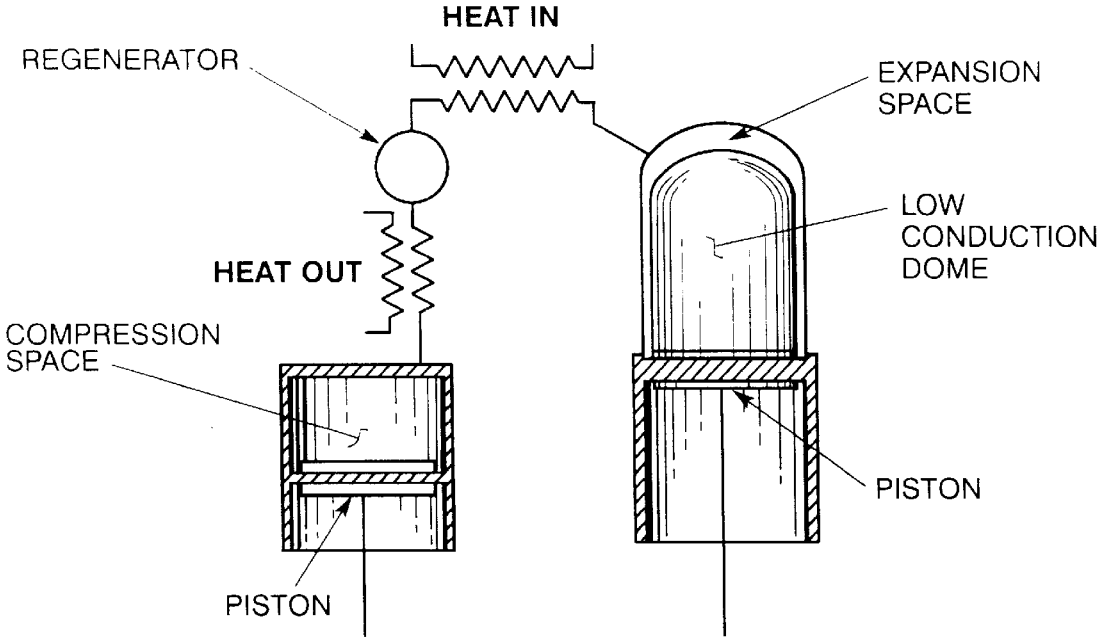
FIG. 1. (PRIOR ART)
FIG. 1 illustrates the operation of a prior art reciprocating Stirling machine.

Stirling machines, whether as refrigerators or engines, operate by closed cyclic compression and expansion of a gas. The basic elements of a Stirling machine, as shown in FIG. 1, are an expansion space, a compression space, and heat input, heat rejection and regenerative heat exchangers. The regenerator acts as an energy-conserving thermodynamic capacitor which alternately transfers heat to or from the working gas as it cycles between the expansion and compression spaces. With a perfect regenerator, the Stirling cycle approaches the ideal Carnot efficiency. Without one, a Stirling machine would be impractically inefficient.

In conventional prior art Stirling machines, two pistons (or a piston and displacer) reciprocate in cylinders synchronously but out of phase so that the working gas shuttles cyclically from one space to the other as the volume and pressure vary from maximum to minimum. The expansion space piston leads the compression space piston by about 90 degrees. Compression occurs when the working gas is mostly in the compression space. Similarly, expansion occurs when the working gas is mostly in the expansion space. Heat is alternately absorbed into the expansion space and rejected from the compression space. If heat is supplied to the expansion space at a temperature higher than that of the compression space, then shaft output power is produced. Alternatively, if drive power is input then heat can be absorbed into the expansion space at a temperature lower than that of the compression space and refrigeration is produced. In either case, the regenerator conserves the far greater heat transfers required for the gas to cycle between the warm and cold temperatures.

Figure 2:
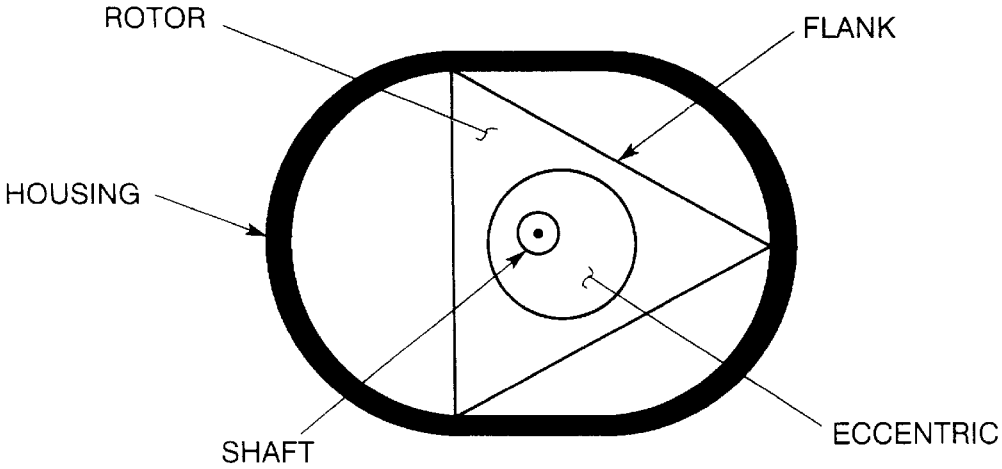
FIG. 2. (PRIOR ART)
FIG. 2 is a simplified illustration of a prior art Wankel engine mechanism.

In the interest of circumventing the limitations of reciprocating Stirling machines (vibration, high drive mechanism forces, and relatively large dimensions for a given power level) the present invention employs two prior art Wankel mechanisms of FIG. 2 instead of the reciprocating pistons of FIG. 1. As shown in FIG. 2, a Wankel rotary mechanism consists of a two-lobed epitrochoidal housing enclosing a three-lobed rotor that rotates on a shaft such that the rotor tips closely follow the inner contour of the housing. A bore through the center of the rotor rides on an eccentric journal of the shaft. Rotation of the rotor on the shaft is controlled by an internal ring gear attached to the rotor which orbits a stationary spur gear (not shown). These gears only maintain the proper epitrochoidal motion of the rotor in the housing as the shaft turns and do not transfer working torque. The shaft is centered in the housing and rotates at three times the rotor speed.

There are three separate volumes formed between the flank of the rotor and the inside of the housing. The volume of each of these three spaces cycles from maximum to minimum twice per revolution of the rotor. Spring-loaded seals on the apexes and sides of the rotor, which move only slightly to accommodate machining tolerances, limit leakage among these three active volumes. As a rotary Stirling machine, the Wankel configuration is well suited to employ nonrubbing close-tolerance clearance seals, since the running clearances can be much more rigidly controlled than in a reciprocating piston machine.

Work is transferred through the machine as shaft torque without need for connecting rod bearings and reciprocating acceleration forces, thus alleviating bearing loads and lubrication. Also, as explained later, the rotors rotate at one-third of the Stirling cycle frequency. This alone reduces vibration forces, which are proportional to rotation (or reciprocation) rate squared, by a factor of 9 in addition to the inherent balance advantages of a rotary machine compared to a reciprocating machine. Although the rotors orbit the shaft axis on eccentrics, because their bores are through their mass centers the assembly can be completely balanced to eliminate vibrations in all planes by a simple counterweight attached to the shaft. Such is not possible in reciprocating machines.

A more detailed description of the Wankel mechanism is given in Wankel U.S. Pat. No. 2,988,065, issued Jun. 13, 1961.

The improved Stirling machine of the present invention is best understood conceptually with reference to FIGS. 3A–3D in which the machine 30 is shown to comprise an expansion side Wankel mechanism 31 and a compression side Wankel mechanism 32 interconnected through first and second stationary regenerators, 33 and 34, respectively.

The two Wankel mechanisms have generally the same forms or configurations but not necessarily the same dimensions. Each has an epitrochoidal or two-lobed housing (35 and 36, respectively, for the expansion and compression mechanisms) and a generally triangular three-lobed rotor (37 and 38, respectively for the expansion and compression mechanisms) as described earlier for the prior art Wankel mechanism of FIG. 2.

Each of the two housings has two inlet/outlet ports situated opposite each other on the transverse (minor) axis of symmetry. For mechanism 31, the ports are designated as 39 and 40, and for mechanism 32 they are designated as 41 and 42.

Each of the regenerators functions as a passive thermal capacitor with a capability for storing thermal energy and with low thermal and flow resistance to the working gas. In a first embodiment, the thermal storage medium (regenerator matrix) is a tightly packed stack of stainless steel screens.

The two regenerators 33 and 34 are connected by means of ducts 43 between the expansion and compression mechanisms 31 and 32 to form the equivalent of two Stirling machines in a single closed system 30.

The mechanical phasing of the rotors 37 and 38 is such that the working gas which is contained within the closed system is cycled back and forth, as indicated by the arrows 44, through each regenerator between the expansion side and the compression side, absorbing heat at the expansion side and releasing heat at the compression side.

Figure 3A:
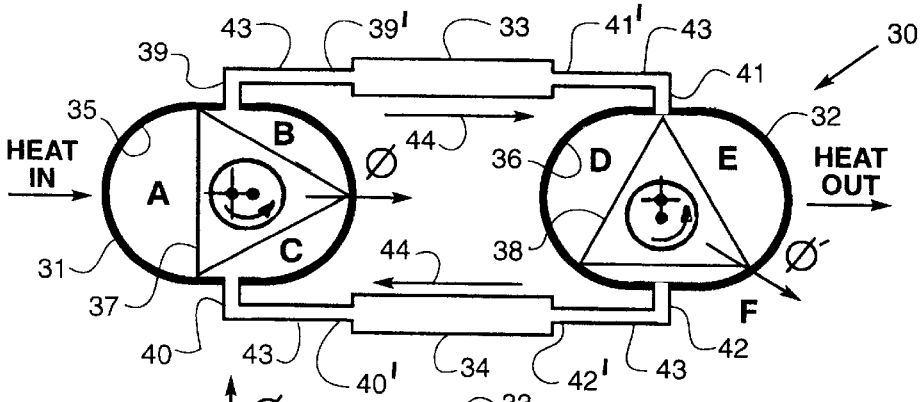
FIGS. 3A–3D illustrate the cyclic variations of the Wankel Stirling working volumes through 360 degrees of rotor rotation in accordance with the principles of operation of the refrigerator or engine of the present invention.
Figure 3B:
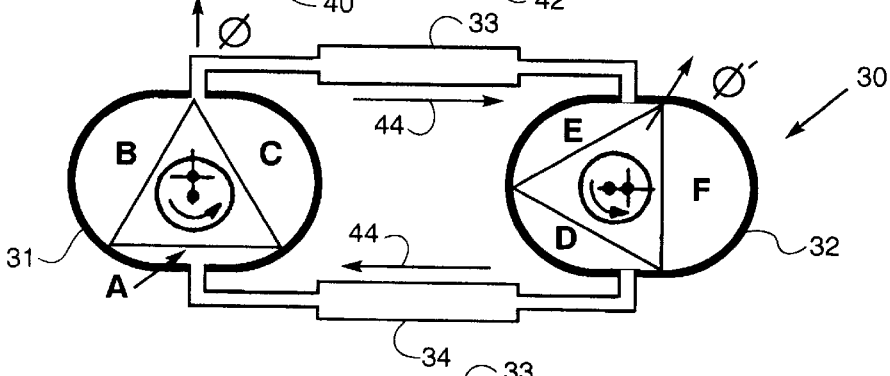
Figure 3C:
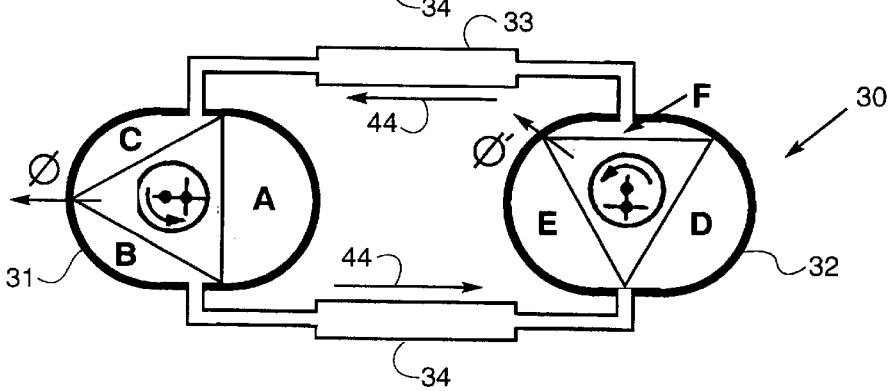

As depicted in FIG. 1, to function as a Stirling machine a heat input (expansion) space must be coupled to a heat rejection (compression) space through a heat capacitor (regenerator), and the volume cycle of the expansion space should lead that of the compression space by about 90 degrees. The corresponding functioning of the subject Wankel-Stirling is best seen from the perspective of a regenerator. FIGS. 3A–3D show the rotating volumes A, B and C of mechanism 31 and volumes D, E, and F of mechanism 32 as they vary with rotor position. Although each of the rotating volumes cycles from minimum to maximum twice per rotor revolution, each regenerator sees three volume cycles per revolution. For example, at a rotor angle Ø of 90 degrees, as shown in FIG. 3B, volume A is at a minimum while volumes B and C are each near a maximum. At this point, volumes B and C are at equal volumes, pressures, and temperatures and are therefore thermodynamically equivalent (i. e. volume C may substitute for volume B in the Stirling cycle). Because the regenerator port 39 is on an axis of symmetry, regenerator 33 sees the transition from volume B to volume C as a smooth progression in a volume cycle from a maximum (equal to either volume B or C) toward a minimum which occurs 60 degrees of rotation later when volume C reaches a minimum.

Thus, each regenerator sees a complete volume cycle at each end every 120 degrees of rotor rotation (e.g. a cycle maximum as each rotor apex passes the regenerator port). Therefore, 90 degrees (one-quarter) of a volume cycle equals 30 degrees of rotor rotation. The rotors on the left side of FIGS. 3A–3D are shown at positions 30 degrees of rotation ahead of the corresponding rotors on the right side. This depicts the required Stirling phasing in which the expansion space volume cycle leads the compression space volume cycle by a phase angle of 90 degrees (i.e. one-quarter of a cycle, 30 degrees of rotor rotation). The phasing of the volume cycles causes the working gas to flow back and forth through the regenerators while generating two pressure cycles which are 60 degrees of rotor rotation apart. Thus 3 Stirling cycles are completed for each regenerator each rotor revolution.

Although the expansion and compression spaces rotate, the subject arrangement allows use of simple, stationary regenerators. In contrast, previous concepts for rotary Stirling machines have required much more complex mechanisms and arrangements of counterflow heat exchangers. The heat input and heat rejection heat exchangers are respectively incorporated in the expansion and compression housings. Heat transfer between the working gas and the housing walls is enhanced by the dwell time of the gas in being swept between regenerator ports in the housing (e.g. volume A at rotor angles of 0 degrees and 180 degrees in FIGS. 3A and 3C). This arrangement also facilitates hermetic integration of a simple rotary motor (or generator in the case of a Wankel-Stirling engine) at the outboard end of the compression housing, which is cooled by the same heat sink as the compression housing. Good thermal separation can be achieved between the warm and cold ends of the assembly.

The first embodiment of the present invention as a cryocooler 30 is shown in FIGS. 4–6. As shown in FIG. 4, a brushless DC drive motor 45 is mounted at one end of the assembly to drive a shaft 46 that extends the full length of the assembly. The compression rotor 38 is eccentrically mounted upon the shaft 46 adjacent the motor 45 and the expansion rotor 37 is eccentrically mounted upon the shaft 46 at the end opposite the motor 45. The shaft 46 is supported by three shaft bearings 47, 48 and 49 and is connected directly to the motor rotor 51. The compressor rotor and the expansion rotor are mounted on eccentric journals on shaft 46 by means of bearings 52 and 53, respectively.

The entire assembly is enclosed in a hermetically sealed housing 54 which includes a pressure dome 55 at the end opposite the motor 45. The interior of the housing is pressurized with the working gas to the cycle mean pressure for high operating efficiency and to counter leakage of working gas from the working spaces of the cryocooler. A fill valve 56 is provided at the motor end of the housing 54 to charge the system with working gas.

A heat sink interface 57 radially surrounds the compression mechanism 32 and a refrigeration interface 58 surrounds the expansion mechanism.

The configurations of the Wankel compression and expansion mechanisms are illustrated by the cross-sectional views of FIGS. 5 and 6, respectively.

As shown in FIG. 5 and as described earlier, the compression mechanism incorporates a two-lobed epitrochoidal housing 36, a three-lobed triangular rotor 38, and two inlet/outlet ports 41 and 42. Also shown in FIG. 5 are the compression heat sink interface 57, rotor bearing 52, rotor side seals 59 and 61 and rotor apex seals 62. The compression mechanism housing 36 is clamped between sections of the cryocooler housing 54 by means of bolts 63 (FIG. 4) that pass through the circle of holes 64 surrounding the periphery of the epitrochoidal housing.

As shown in FIG. 6, the expansion mechanism 31 is very similar to the compression mechanism but smaller dimensionally. Its three-lobed rotor has similarly arranged rotor side seals 65 and 66, rotor bearing 67, and rotor apex seals 68. Its two-lobed epitrochoidal housing 35 has inlet/outlet ports 39 and 40, as also shown in FIGS. 3A–3D, and it has a circle of bolt holes 69 surrounding its periphery for being secured at the end of the cryocooler housing 54.

An important feature of the invention is the means employed for mechanically balancing the rotor assembly to minimize vibration. The essential thermodynamic phasing is coordinated with the inertial phasing in such a way as to permit balancing of the expansion and compression rotors with a single counterweight attached to the drive shaft. Although the two rotors are of unequal masses and rotate on eccentric journals while orbiting the shaft axis at different fixed radii, the machine can be simply and completely balanced to virtually eliminate all vibration due to rotor rotation as explained below.

Since the rotors rotate about their centers on the journals, each rotor can be individually balanced about its center. The only remaining unbalanced components are the radial forces due to the rotor mass centers orbiting the shaft axis, and the moment due to the separation between the radial forces.

A conventional balancing method would be to counterbalance each rotor with a diametrically opposed mass such that the product of each mass and its radius from the shaft axis equaled that of the corresponding rotor, thereby canceling the radial forces and eliminating the moment. This would require radial clearance around the shaft next to each rotor and would leave unequal residual moments because the counterweights cannot be exactly coplanar with the rotors.

A preferable balancing approach is to employ a single counterbalance with proper combination of mass and positioning to simultaneously cancel the unbalance radial forces and moment. But such a single counterbalance must be axially located beyond (outboard of) the heavier rotor from the lighter rotor, elongating the shaft and housing, unless the rotor mass centers are aligned at the same angle (in phase) about the shaft. This would seem to conflict with the 90 degree phasing required for the Stirling cycle. However, the unique stationary regenerator design of the present invention allows coordination of the inertial and thermodynamic phasing simply by rotating the expansion space epitrochoid 90 degrees relative to the compression space epitrochoid and routing the regenerator connections accordingly. The counterbalance can then be located inboard of the compression rotor where the housing diameter is largest and there is adequate clearance around the shaft. Since the product of the single counterbalance mass and its radius from the shaft axis must equal the sum of the rotor products, it need be no heavier than any other counterbalancing arrangement even though the rotor mass centers are aligned on the same side of the shaft.

In accordance with the balancing approach just described, the epitrochoidal housings 35 and 36 of the expansion and compression mechanisms 31 and 32, respectively, are mechanically oriented 90 degrees apart as shown in FIGS. 5, 6 and 7. A comparison of FIG. 7 with FIG. 3D will show that the only difference is the angular orientations of the two epitrochoidal housings, 31 and 32. The thermodynamic phasing is therefor left undisturbed.

Figure 3D:
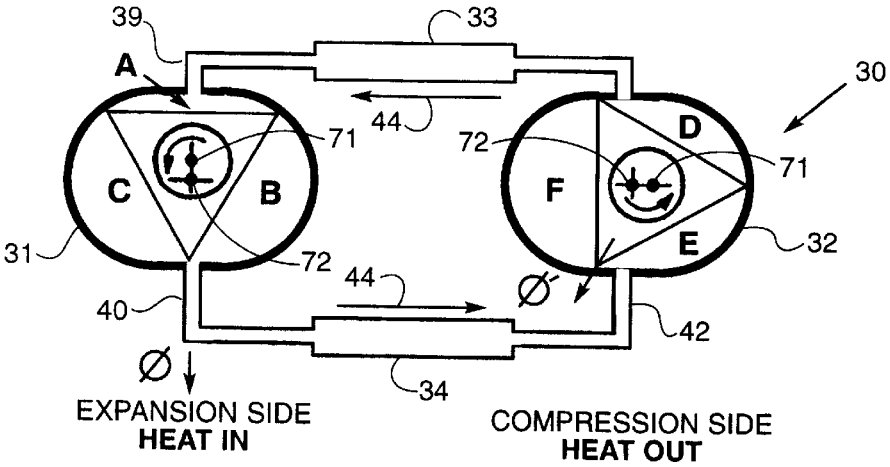

At the same time, the inertial phasing is altered in a manner which permits the desired balancing approach. When the compression mechanism of FIG. 3D is rotated 90 degrees counterclockwise, to the position shown in FIG. 7, the mass centers 71 of the two rotors are aligned on the same side of the drive shaft. Accordingly, the two rotors may now be effectively balanced by means of the single counterweight 73 mounted directly to the drive shaft 46 at a location intermediate between the two rotors at which the forces and moments of the two rotors are balanced.

A new and improved Stirling machine is thus provided in accordance with the objects of the invention. Although only one embodiment of the invention has been illustrated and described, it will be apparent to those skilled in the art that various changes and modifications may be made therein without departing from the spirit of the invention or from the scope of the appended claims. It should also be noted that, as is characteristic of Stirling-cycle machines in general, variations of the present invention are not limited to use as cryocoolers but may be employed as refrigerators over a wide range of temperatures and capacities and, if heat is supplied to the expansion space at a temperature higher than the compression space, may function as prime movers converting heat input to shaft power output.

What is claimed is:

1. A heat exchanger based on the Stirling cycle wherein said heat exchanger comprises:

a rotary expander mechanism having a rotor, a housing with a heat input interface, and first and second working gas inlet/outlet ports;

a rotary compressor mechanism having a rotor, a housing with a heat rejection interface, and first and second working gas inlet/outlet ports;

a drive means for driving the rotary expander mechanism and the rotary compressor mechanism;

first and second stationary regenerators, each having first and second working gas inlet/outlet ports; and a working gas contained within said expander mechanism, said compressor mechanism, and said regenerators;

said first mechanism having its first working gas inlet/outlet port connected to said first working gas inlet/outlet port of said expander mechanism and its second working gas inlet/outlet port connected to said first working gas inlet/outlet port of said compressor mechanism;

said second regenerator mechanism having its first working gas inlet/outlet port connected to said second working gas inlet/outlet port of said expander mechanism and its second working gas inlet/outlet port connected to said second working gas inlet/outlet port of said compressor mechanism;

the expander mechanism and compressor mechanism being connected together through said regenerators to form the equivalent of two Stirling-cycle systems, the resulting closed system containing said working gas;

whereby in operation each of said regenerators is exposed at its first working gas inlet/outlet port to pressure cycles from said expander mechanism and at its second working gas inlet/outlet port to pressure cycles from said compressor mechanism;

said pressure cycles of said expander mechanism and compressor mechanism being generated at a common frequency related to the speed of rotation of said drive means, with the pressure cycles of said expander mechanism leading those of said compressor mechanism by approximately ninety degrees such that said working gas is swept back and forth between said expander mechanism and said compressor mechanism through said regenerators with heat being rejected at said heat rejection interface of said compressor mechanism and heat being absorbed at said heat input interface of said expander mechanism in the manner of a Stirling refrigerator;

said closed system functioning as a refrigerator when heat is absorbed into the expander mechanism at a temperature lower than that of the compressor mechanism and power is input to the drive means.

2. The heat exchanger set forth in claim 1 wherein:

a rotary expander mechanism having a rotor, a housing with a heat input interface, and first and second working gas inlet/outlet ports;

a rotary compressor section having a rotor, a housing with a heat rejection interface, and first and second working gas inlet/outlet ports;

a drive means for driving the rotary expander section and the rotary compressor section;

first and second stationary regenerators, each having first and second working gas inlet/outlet ports; and a working gas contained within said expander mechanism, said compressor mechanism, and said regenerators;

said first regenerator having its first working gas inlet/outlet port connected to said first working gas inlet/outlet port of said expander mechanism and its second working gas inlet/outlet port connected to said first working gas inlet/outlet port of said compressor mechanism;

said second regenerator having its first working gas inlet/outlet port connected to said second working gas inlet/outlet port of said expander mechanism and its second working gas inlet/outlet port connected to said second working gas inlet/outlet port of said compressor mechanism;

said expander and compressor mechanism being connected together through said regenerators to form the equivalent of two Stirling-cycle systems, the resulting closed system containing said working gas;

whereby in operation each of said regenerators is exposed at its first working gas port to pressure cycles from said expander mechanism and at its second working gas port to pressure cycles from said compressor mechanism;

said pressure cycles of said expander and compressor mechanism being generated at a common frequency related to the drive means, with the pressure cycles of said expander mechanism leading those of said compressor mechanism by approximately ninety degrees such that said working gas is swept back and forth between said expander mechanism and said compressor mechanism through said regenerators with heat being rejected at said heat rejection interface of said compressor mechanism and heat being absorbed at said heat input interface of said expander mechanism in the manner of a Stirling engine;

said closed system functioning as an engine when heat is supplied to the expander mechanism at a temperature higher than that of the compressor mechanism and power is output by the drive means.

3. The heat exchanger set forth in claim 1 wherein said expander mechanism and said compressor mechanism each comprises a three-lobed rotor and a two-lobed epitrochoidal housing in the geometry of the Wankel mechanism.

4. The heat exchanger set forth in claim 3 wherein:

the two-lobed housing of said compressor mechanism is angularly displaced approximately ninety degrees from the two-lobed housing of said expander mechanism and the mass centers of the respective two rotors are aligned together, thereby enabling the balancing of the rotors with a single counterweight attached to the shaft coupling said rotors while maintaining the Stirling cycle phasing so that the pressure cycles of said expander mechanism lead those of said compressor mechanism by approximately ninety degrees.

* * * * *